United States Patent [19]

Hodson

[11] 4,185,934

[45] Jan. 29, 1980

[54] FILLER CRADLE FOR LOOSELEAF RINGBINDERS

[76] Inventor: Hollis C. Hodson, P.O. Box 114, Amo, Ind. 46103

[21] Appl. No.: 903,531

[22] Filed: May 18, 1978

[51] Int. Cl.[2] ..... B42F 7/00

[52] U.S. Cl. ..... 402/80 L; 402/24

[58] Field of Search ..... 402/24, 80 R, 80 L

[56] References Cited

U.S. PATENT DOCUMENTS

| | | | |
|---|---|---|---|
| 791,296 | 5/1905 | Shepherd | 402/80 L |
| 2,090,231 | 8/1937 | Raynolds | 402/80 L |
| 2,453,459 | 11/1948 | Roberts | 402/80 L |
| 2,639,713 | 5/1953 | McKowen | 402/24 |
| 3,306,301 | 2/1967 | Mason | 402/80 L |
| 3,493,310 | 2/1970 | Orth et al. | 402/24 |

FOREIGN PATENT DOCUMENTS

| | | | |
|---|---|---|---|
| 1101686 | 1/1968 | United Kingdom | 402/80 L |

*Primary Examiner*—John McQuade

[57] ABSTRACT

A deformable cradle, after reposit in, and beneath the looseleaf filler of, a ringbinder notebook, assists collection of the filler whenever the open ringbinder is closed. The cradle designs fit ringbinders employing two or more rings and accommodate ring widths from about one to three inches (25 to 75 mm). A binary guide is described; unitary cradles are shown and described; a cradle is shown and described as employing an independent centering means attached; methods and materials are shown and described for effecting dependent connections of a cradle to the spine of a ringbinder, both permanently and removably. Improvement resides in ability of a cradle to usher the filler out of the troughs under the ringbinder rings where filler stock is prone to catch and bind during ringbinder closure.

4 Claims, 5 Drawing Figures

FILLER CRADLE FOR LOOSELEAF RINGBINDERS

BACKGROUND OF THE INVENTION

This invention relates to filler guides often used in looseleaf ringbinder notebooks. When an open, filled ring-binder is closed for storage, guides are intended to fold up against outer portions of the divided filler, compress the separated parts, and follow such parts up and around ring peripheries toward the upper arcs of the rings.

Usually, rings are encased in a metal spine which is attached to the ringbinder saddle. When the ringbinder and its filler open and separate, portions of the filler will gravitate to one or other of the covers. Whereas the chord across a ring, i.e., from where a ring enters and exits the spine, is less than the level diameter of the ring, some of the stock must always repose along the rings below and inward of the ring widths and overlapping the spine edges. Without some guiding means, lowermost stock is trapped in a trough under the rings, and tends to skid grudgingly as the covers close. Reluctance of covers to move smoothly is not only an annoyance but in addition makes it difficult to close a book without tearing holes in some of the filler.

A commonly supplied relief for such problems is a pair of narrow, half-hard filler guides for use between covers and filler. These rigid guides, having enlarged and elongated ring holes to facilitate their movement, provide very little leverage but do hold the filler together as it moves upward and inward to close. However, all too often, one or both of the guides themselves wedge ineffectually under the rings.

SUMMARY OF THE INVENTION

The invention discloses deformable cradles for reposit in, and beneath the looseleaf filler of, a ringbinder notebook, whereupon the cradles assist in the collection of the filler whenever the open ringbinder is closed. Cradles are of deformable sheet material, about filler stock shape and size; unitary cradles are characterized by two columns of slots transversely paired astride a middle inch (25 mm) of a single sheet. The single sheet design enables a cradle to enter the open rings, cross the spine, and exit the rings in one piece. The preferred cradle fits ringbinders employing two or more rings, accommodates ring widths from about one to three inches (25 to 75 mm), and unitarily underlies the central portion of an open filler, where, upon closure, ring-bound edges of bottom filler stock are rapidly and evenly lifted and compressed from opposing directions and before such stock can catch and bind below the rings. Having once reached the upper ring quadrants, the filler experiences no further hindrance to closure.

Cradle material is described as having an inherently waxy surface and a more rigid consistency than a unit of commonly used stock material. For small capacity ring-binders a very thin plastic sheet suffices as a cradle, and centering is controlled by a narrow strip of material between slot columns, which solid strip also allows the cradle to arch rather than fold upon closure. Medium and large ring-binders require the cradle to employ a heavier wall thickness for more rigid leverage, whereupon a heavier cradle is slit along the mid-line so the sides can be hinged. Connective bonds, preferably two or more, are left along the cradle mid-line to serve as integrant hinges. Cradle halves are folded and the hinges creased to mark the fold-line.

It is submitted that a cradle works best when it centers along the mid-line of the ringbinder spine. The unitary cradle stays centered within minimal rings and centers in general in medial and maximal rings. Centering tolerance is delimited by using a centering bar aligned symmetrically beneath the cradle fold-line and stapled beneath the hinges, which bar is made of cradle material and narrow enough to be enclosed, and to repose, within rings. For exact centering, cradle hinges are riveted to the mid-line of a ringbinder spine; also, buttonhead rivets are pre-anchored in the mid-line of a spine and cradle hinges are slit transversely for buttoning the cradle hinges onto the rivets.

The object of the invention is to make any looseleaf ringbinder open and close as smoothly as any commercially bound hard cover book.

Improvement resides in the ability of a cradle to usher the filler out of the trough under the ringbinder rings where filler stock is prone to catch and bind during ringbinder closure.

DESCRIPTION OF THE PREFERRED EMBODIMENT

Glossary—hereinafter, as used in this description:

"ringbinder" means a looseleaf ringbinder notebook;

"filler" refers to a quantity of a looseleaf paper prepared for use in, and contained by, a ringbinder;

"cradle" means a unitary deformable, filler control device for use beneath a filler in a ringbinder;

"stock" is used to describe filler paper in order to avoid confusing paper filler sheet with plastic cradle sheet;

"rings" refer to openable, ringbinder detainers for filler;

"width of a ring" means outside diameter of a closed ring;

"minimal ring" is lower range size, about 1" (25 mm) wide;

"maximal ring" is upper range size, about 3" (75 mm) wide;

"spine" refers to a rigid encasement on a ringbinder saddle for housing and positioning rings;

"slots" are elongated openings through the cradle material;

"mid-strip" refers to an area between slot columns, preferably flat and about 1" (25 mm) astride the cradle mid-line;

"slits" are elongated incisions through the cradle material;

"holes" are any small apertures in cradle or spine;

"hinges" include bonds of uncut material in the partially slit mid-line of a cradle;

"fold-line" is the mid-line of a cradle marked for folding;

"centering bar" means a strip of cradle material aligned symmetrically beneath the fold-line and attached beneath the hinges, thence encloseable within rings;

"staple" is a narrow clasp which anchors firmly; and

"rivet" is a headed pin which can be anchored firmly.

Figure 1:
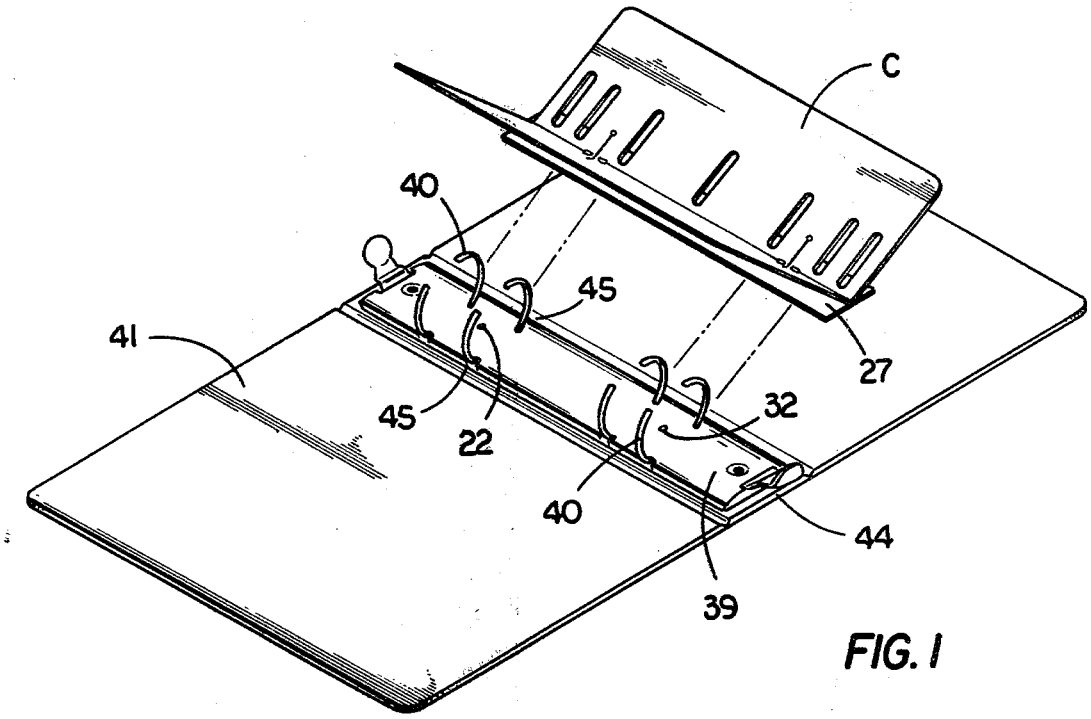
FIG. 1 is a projected view of a cradle, centering bar attached, relative to insertion within an open ringbinder, and illustrating rivet sites in the ringbinder spine.

In the drawings, FIG. 1, the looseleaf ringbinder has a rigid spine 39 attached along the saddle 44 of the ringbinder notebook. As well as containing the toggle mechanism which opens and closes the rings, the spine houses and positions rings 40. In the FIG. 1 open ringbinder, rings 40 enter the spine 39 at points below the level ring widths thus creating a trough 45 along each side of the rings between ring widths and flat ringbinder covers 41. The larger the ring, the more acute trough 45 becomes. Lower units of filler stock, when deposited on opened covers, tend to remain in this trough under the inward curvature of the rings, even more so as the covers elevate to close. Closure then pinches and binds butts of lower stock between cover and rings such as to interfere with smooth closing of the ringbinder. One way to eliminate entrapment of the filler is to bridge over the troughs 45.

Figure 3:
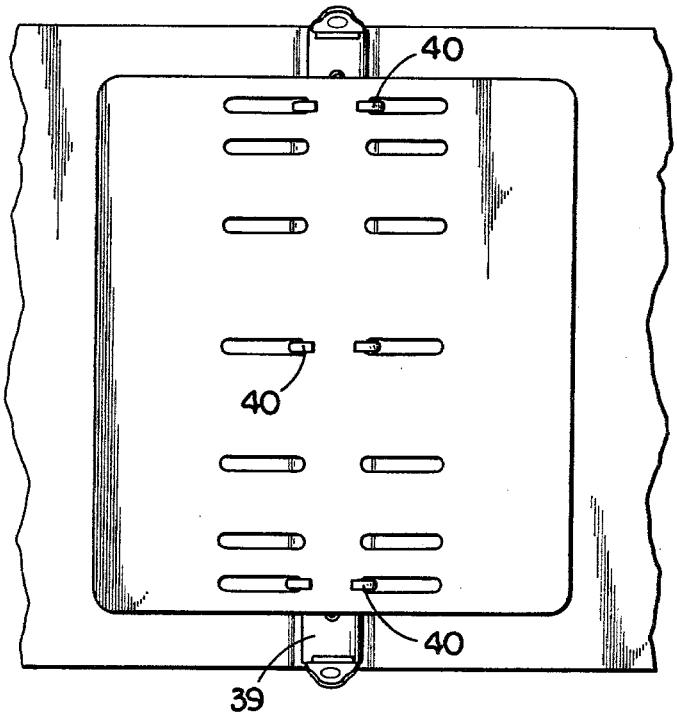
FIG. 3 is a fragmentary top view of a flat, open ringbinder having a suitably designed cradle inserted into open rings.

Two-piece guides were designed which sufficed to block the trough entrapment. As an example, where a 2" (5.1 cm) ringed binder used 8½×11 inch (21.6×27.9 cm) filler, two polyethylene guides—sized about 9½×5½ inches (24×14 cm) and having ¼" (6.4 mm) ring holes—performed to span over the troughs when the hole columns were inset about ¾" (19 mm) from the inner edges of the guides and guide thickness was no more than 0.050 inches (1¼ mm) (such that guides could deform slightly along the hole columns). Per ringbinder, however, binary guides required two stampings; also, material thickness and inset of holes had to be somewhat tailored to any given ringbinder capacity. A standard, unitary cradle, on the other hand, was made in one stamping, out of thinner material, to do the same job and do it interchangeably over a wide range of ring sizes and ringbinder capacities. FIG. 3 shows a cradle extending as a unit across spine 39, thus producing, in its effect, a combined base and lever for use against the filler such that closing filler butts can be ushered up and away from the troublesome troughs.

Figure 2:
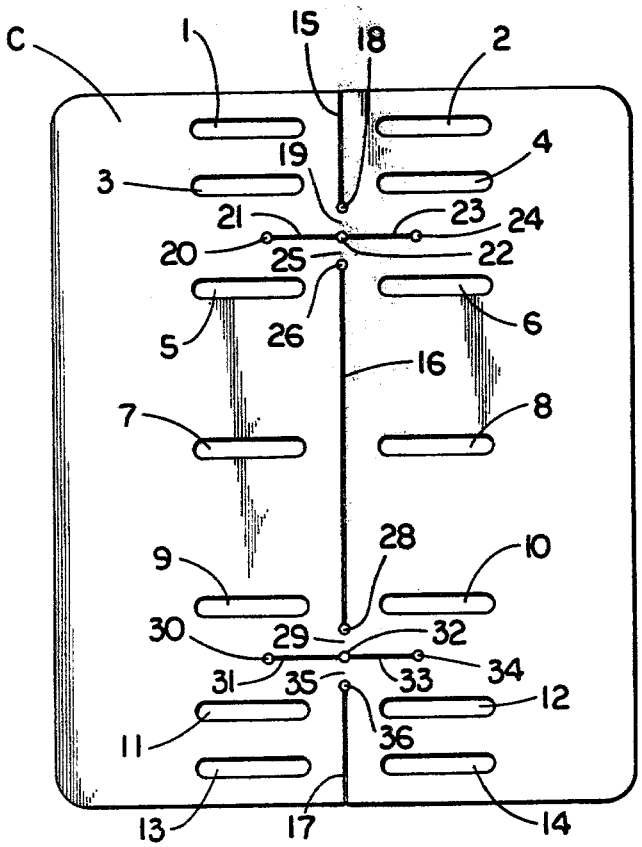
FIG. 2 is a flat view of a cradle which is adaptable to any capacity ringbinder.

Cradle C of FIG. 2 was designed for use in conventional ringbinders, i.e., ringbinders having two or more rings, and wherein the rings might range from about 1 to 3 inches (25 to 75 mm). Multi-slot columns were formed astride the mid-line of the cradle leaving about an inch (25 mm) of mid-strip, i.e., no more than could be enclosed within a minimal ring. Slot widths were about 1½" (38 mm), i.e., at least half as wide as a maximal ring. Slot depths were ¼" (6.4 mm), i.e., enough oversize to accommodate a maximal ring cross section.

The preferred FIG. 2 cradle C was made of material somewhat tougher and more rigid than the heaviest grade paper commonly used as filler stock, e.g., high density polyethylene sheet. Such sheet is flexibly deformable and has an inherent waxy surface to discourage friction between cradle and filler stock. Sheet plastic often has one glossy side and the other side a matte finish. The matte side offers less friction to paper filler. Surface area and cradle shape was preferred to be relatively near respective filler stock since this enabled the cradle to underlie the central portion of opened filler when filler was inserted over the cradle in the ringbinder.

Ringbinders having about 1" (25 mm) rings are seldom troublesome unless heavily loaded or loaded with flimsy stock. In any case, FIG. 3 illustrates a suitably slotted cradle which sufficed for 1 to 1⅜" (25 to 35 mm) rings using a polyethylene sheet thickness of only about 0.020" (½ mm). The mid-strip between slot columns kept the cradle centered and possessed low enough flexibility to deform readily upon flexing when the ringbinder was opened and closed.

For overall capacity ringbinders, however, the standard, stamped cradle design, cradle C of FIG. 2, was preferred, and in a thickness of about 0.030" (¾ mm). This thickness range required draining mid-line flexibility in order to enable the ready folding and unfolding responses within the ringbinder. A satisfactory supple unity was obtained by slitting along the mid-line of the cradle, FIG. 2, 15, 16, 17, leaving short bonds near each mid-line extremity and in a region available between likely ring locations as shown in FIG. 2, upper bonds 19, 25, and lower bonds 29, 35. Once cradle halves were folded and creased the connective bonds served as marked hinges and the halves thereafter flexed readily and indefinitely without loss of cohesion. Small holes, FIG. 2, 18, 26, 28, 36, were stamped at ends of hinge bonds to terminate slits 15, 16, 17.

Figure 5:
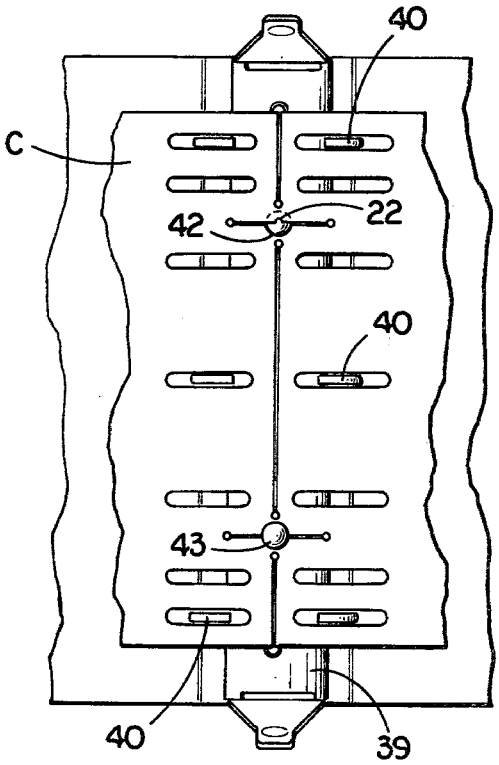
FIG. 5 is a fragmentary top view of a flat, open ringbinder and cradle combination illustrating means of attaching the cradle symmetrically to the ringbinder spine within the rings.

The unitary cradle is adaptable to any ringbinder of the common ring widths. For examples, FIG. 3 portrays a 3-ring binder of small capacity, range about 1" (25 mm), using slots 1, 2, 7, 8, 13, 14, of FIG. 2; FIG. 1 portrays a 4-ring binder of medium capacity, range about 2" (50 mm), using slots 3, 4, 5, 6, 9, 10, 11, 12, of FIG. 2; FIG. 5 portrays a 3-ring binder of large capacity, range about 3" (75 mm), using slots 1, 2, 7, 8, 13, 14, of FIG. 2. However, to refine the benefits of the unitary cradle of FIG. 2, it was preferable to develop both independent and dependent means for keeping a cradle near the center of the ringbinder spine in order that pressure and movement would be equalized between covers when an open, filled ringbinder was closed. Centering was sufficiently assured by attaching a self-centering device to the independent cradle, and again by attaching the cradle mid-line to the spine mid-line.

Figure 4:
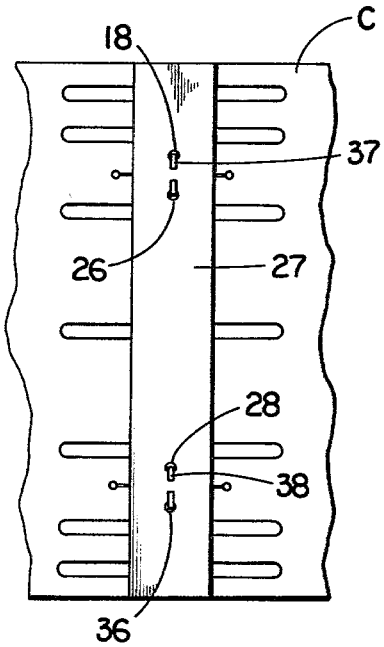
FIG. 4 is a fragmentary bottom view of a cradle having a centering bar stapled beneath and along the fold-line of the cradle.

FIG. 1 illustrates a self-centering bar 27 attached to the cradle C of FIG. 2. Bar 27 was made of cradle material at about 1¼" (32 mm) width and of cradle length. Holes 18, 26 and 28, 36 of FIG. 4 were punched along the mid-line of bar 27 to match respectively holes 18, 26 and 28, 36 of FIG. 2. The staples 37, 38 through the matched holes were clinched as is illustrated in inverted view, FIG. 4. Resulting cradle and bar combination had the advantage of being transferable to any ringbinder wherein the bar 27 could be enclosed, i.e., wherein the rings were about 1½" (38 mm) or more in width. Inasmuch as ringbinder spines are made with a cross sectional crown as illustrated by 39 in FIG. 1, bar 27 tended to skid generally and self-center under pressure of ringbinder closure, even in those cases where the ring width was noticeably in excess of the bar width, i.e., within rings above 2" (50 mm).

Whereas it might be a desirable condition to have the filler cradle a fixed part of a ringbinder combination, cradle C of FIG. 2 was exactly centered upon the ringbinder spine by permanent, and removable, attachment as described below.

In FIG. 1, the holes indicated at 22 and 32 were located along the spine 39 to align with holes 22 and 32 of FIG. 2 such that cradle C could be aligned and centered upon spine 39 and attached through the matched holes into the relationship shown in FIG. 5. Split buttonhead rivets were employed as illustrated by 43 of FIG. 5, the legs of the rivets having been opposedly forced in between the crowned surface of the spine and the underlying toggle strips within the encasement. Such disposal did not interfere with the normal functions of the toggle mechanism and left the cradle firmly centered within the rings as a fixed accessory of the ringbinder.

Whereas it might probably be a more advantageous procedure to pre-anchor rivets or the like during assembly of a ringbinder spine, FIG. 5 illustrates the situation wherein buttonhead rivets or the like were pre-anchored in the spine and the cradle C adapted to button over the exposed heads. Such procedure had the advantage of leaving any given ringbinder, regardless of capacity, prepared for selective use of a standard cradle stamping such as cradle C of FIG. 2.

In the preferred FIG. 2 cradle, transverse upper slits 21, 23 and lower slits 31, 33 were cut transversely to end respectively at holes 20, 24 and 30, 34 such that overall slits, from 20 to 24 and from 30 to 34, were at least as long as the respective hinges 19 plus 25 and 29 plus 35. Transverse slits allowed the cradle hinges to be puckered at holes 22 and 32 such that the slits became, in effect, buttonholes for buttoning the cradle C to the buttonheads 42 and 43 of FIG. 5.

In FIG. 5, buttonhead 43 illustrates cradle C as having been buttoned upon spine 39 whereas buttonhead 42 is shown as half-buttoned. The top half of hole 22, FIG. 5, is to be, in turn, buttoned under head 42 by slightly raising the upper end of the cradle which, in turn, puckers cradle hinge part 19 of FIG. 2 such that it can shoehorn into place under the rivet.

Once buttoned onto rivet heads, cradle C of FIG. 2 kept its trapped position unless and until forceably removed. Thus, for use in a ringbinder, FIG. 2 cradle C was adaptable (1) for use unmodified, (2) for use with centering bar 27 as in FIG. 1, and (3) for use by permanent or removable attachment as portrayed in FIG. 5.

The devices and adaptations above described suggest the manufacturing feasibility of the cradle concept, and reveal improvements which reside in, and derive from, the ability of a cradle of unitary structure to usher ringbinder filler stock out of the trough under the rings where the stock is otherwise prone to catch and bind during ringbinder closure. In every instance the unitary structure was superior in performance to any binary structure devised for comparison.

The descriptions do not attempt to exhaust designs, devices, and methods for combining, centering, and anchoring a filler cradle. However, the disclosure contemplates such modifications as would expectedly produce equivalent results.

What is claimed is:

1. A cradle for collecting looseleaf filler butts within an open ringbinder during ringbinder closure, which said cradle is made by a method comprising the steps of:
   a. sectioning out, from bulk sheet material having suitable properties, a selectively sized, flat, rectangular cradle sheet;
   b. selectively perforating matched columns of transverse slots in said cradle sheet astride the mid-strip of said cradle;
   c. partially slitting the mid-line of said cradle, leaving conjugated bonds for integrant hinges in said cradle; and
   d. creasing said hinges along said mid-line of said cradle for marking a supple fold-line on said cradle.

2. The cradle according to the method of claim 1, and further comprising the steps of:
   e. shaping a bar of cradlelike material to about cradle length and of width encloseable within ringbinder rings;
   f. aligning said bar symmetrically beneath said hinges; and
   g. stapling said hinges to said bar for keeping said cradle centered within said rings and upon a ringbinder spine.

3. The cradle according to the method of claim 1 and further comprising the steps of:
   e. inserting rivets through the centers of said hinges;
   f. piercing anchor holes in the mid-line of a ringbinder spine to correspond with said rivets; and
   g. riveting said hinges to said spine for keeping said cradle permenently connected to said ringbinder.

4. The cradle according to the method of claim 1, and further comprising the steps of:
   e. forming rivet holes through the centers of said hinges;
   f. slitting said cradle transversely through said centers of said rivet holes to at least hinge-length;
   g. anchoring buttonhead rivets to the mid-line of a ring-binder spine to correspond with said rivet holes; and
   h. buttoning said hinges to said rivets for keeping said cradle removably fastened to said ringbinder.

* * * * *